US006408457B1

(12) United States Patent
Bader

(10) Patent No.: US 6,408,457 B1
(45) Date of Patent: Jun. 25, 2002

(54) BATHROOM UNIT

(76) Inventor: Silvia Bader, c/o Magenta Marketing GmbH Poatfach 701307, D-81313 Munich (DE)

( * ) Notice: Subject to any disclaimer, the term of this patent is extended or adjusted under 35 U.S.C. 154(b) by 0 days.

(21) Appl. No.: 09/807,379

(22) PCT Filed: Sep. 30, 1999

(86) PCT No.: PCT/DE99/03294

§ 371 (c)(1),
(2), (4) Date: May 17, 2001

(87) PCT Pub. No.: WO00/21423

PCT Pub. Date: Apr. 20, 2000

(30) Foreign Application Priority Data

Oct. 12, 1998 (DE) ..... 198 46 941

(51) Int. Cl.[7] ..... A47K 3/24; A47K 10/06
(52) U.S. Cl. ..... 4/598; 4/524
(58) Field of Search ..... 4/598, 545, 524, 4/596, 597, 605, 612–614; 312/236; 52/171.2

(56) References Cited

U.S. PATENT DOCUMENTS

| | | | | | |
|---|---|---|---|---|---|
| 1,669,773 | A | * | 5/1928 | Ober | 4/545 |
| 1,796,273 | A | * | 3/1931 | Sutter et al. | 4/545 |
| 1,927,745 | A | * | 9/1933 | Jonsson | 4/454 |
| 1,955,022 | A | * | 4/1934 | Rodman | 4/545 |
| 3,108,170 | A | * | 10/1963 | Murphy | 4/545 |
| 3,263,242 | A | * | 8/1966 | Will | 4/598 |
| 3,452,369 | A | * | 7/1969 | Jones et al. | 4/524 |

FOREIGN PATENT DOCUMENTS

| | | | | |
|---|---|---|---|---|
| DE | 28 08 611 | A1 | 9/1978 | |
| DE | 93 17 118 | U1 | 4/1995 | |
| DE | 44 38 572 | A1 | 5/1996 | |
| DE | 195 10 017 | A1 | 9/1996 | |
| DE | 296 17 733 | U1 | 3/1997 | |
| DE | 197 10 072 | A1 | 11/1997 | |
| DE | 298 02 057 | U1 | 7/1998 | |
| JP | 5-277041 | A * | 10/1993 | 4/545 |

* cited by examiner

*Primary Examiner*—Charles R. Eloshway
(74) *Attorney, Agent, or Firm*—Oliff & Berridge, PLC

(57) ABSTRACT

What is described is a bathroom unit, in particular in the form of a shower unit (2), comprising a shower tub (12) and a shower unit wall provided with a door (18). A heating device (26), for instance in the form of a rung radiator (28), extends over at least a partial section of the shower unit wall. The shower unit wall may comprise in the region of the heating device (26) an additional door (20) which opens to the interior of the shower unit. The doors (18, 20) preferably are sliding doors.

10 Claims, 3 Drawing Sheets

BATHROOM UNIT

Figure 1:
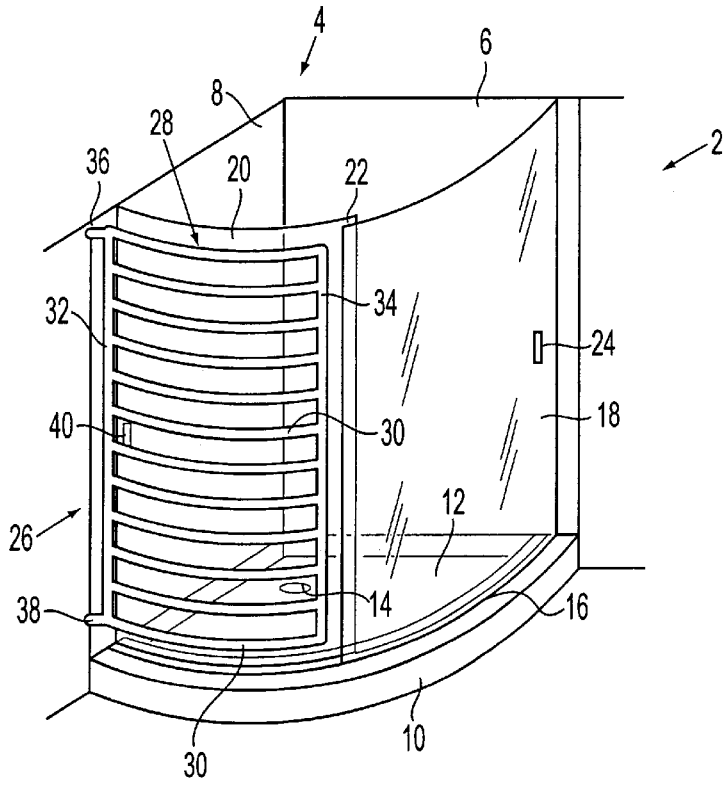

The invention relates to a bathroom unit, in particular a shower unit, in accordance with the preamble of claim 1.

Bathroom units in the form of shower units are well-known. As a rule, they consist of a base incorporating the shower tub and a shower unit wall, by means of which the shower unit can be closed in a splash-proof manner towards the outside. The shower unit wall comprises a door which is, as a rule, designed as sliding door. Such kind of shower units exists in a plurality of different shapes, for instance square, rectangular, triangular, polygonal, sector-shaped (e.g. semi-circular or quarter circular) or round.

The object of the present invention is to further develop a bathroom unit, i.e. in particular a shower unit, such that its practical value is improved.

For solution of this problem, the present invention suggests in accordance with claim 1 that a heating device extends at least over a partial section of the shower unit wall. Alternatively or preferably additionally to the heating device that is for instance available in the bathroom in the form of a heating radiator, the subject matter of the present invention thus provides a heating device at least over a partial section of the shower unit wall. This heating device thus is capable of not only keeping the room in which the shower unit is accommodated at an agreeable temperature, but especially and selectively the interior of the shower unit itself. This very substantially increases the "effect of feeling fine" and thus the practical value of a shower unit pursuant to the invention.

Advantageous embodiments of the invention are the subject matters of the subclaims.

In accordance with a preferred embodiment, the heating device is arranged outside the shower unit wall. The interior of the shower unit thus is heated up indirectly through the shower unit wall, or, respectively, the heating device heats up the directly adjacent shower unit wall which then, in turn, radiates heat into the interior of the shower unit. In addition to a large-surface and even emission of heat, in particular the advantages result that the heating device is protected from splash water and thus from furring up and pollution, and that there is no risk of a person taking a shower to get burnt by the heating device when this is operated at correspondingly high temperatures.

If the shower unit wall comprises in the area of the heating device an additional door that is to be opened towards the interior of the shower unit, the advantage results that the heating device can radiate heat directly into the interior of the shower unit when the door is open, i.e. that increased emission of heat is possible. Furthermore, one or several towels may be hung up behind this door and thus directly in front of the heating device; with the door closed, this towel/these towels are kept in a splash-proof way and are pre-heated by the heating device during the shower process. After showering, the additional door may be opened and the pre-heated towel(s) may be taken out, and drying may be performed within the shower unit, so that no dripping water gets out the of shower unit. The heating device furthermore enables a quick drying of the interior of the shower unit.

The shaping of the heating device preferably is adapted to the shaping of the shower unit; in an especially space-saving and esthetically attractive way, both the shower unit wall and the heating device are curved. This is in particular the case when the shower unit has the shape of a quarter circle, i.e. is intended for corner installation.

A so-called rung radiator is particularly suited as heating device. Such rung radiators are not only attractive as to their optical appearance, but they additionally offer the advantages that they can easily be kept clean and that one or several towels can be directly hung on them.

The doors, i.e. the access door for the shower unit and also the additional door that covers the heating device from the interior of the shower unit preferably are sliding doors since such sliding doors are easy to operate, quickly provide large access or entrance openings and seal off reliably.

In accordance with another preferred embodiment, the heating device may be connected to the cycle of an already existing central heating. The feeding of the hot water can be performed either via wall-side supply and outlet connections or else via supply and outlet connections that are incorporated in the base of the shower tub and project upwardly therefrom.

Likewise, the heating device may be an electric radiator that emits the necessary heating energy either directly or via a heating medium cycle (oil or the like).

If the supply and outlet connections for the heating device, i.e. for instance flow and return in the case of hot water or oil radiators or feeding cables in the case of an electric radiator, are incorporated in the base of the shower tub, the advantage results that no wall connections have to be provided or installed subsequently for the heating device. The bathroom unit is installed and connected as a unit, with all supply and outlet connections and all connections for the heating element being supplied via the base. This is of particular benefit in the case of bathroom renovations since no conduits have to be installed in the wall and a possibly existing file cladding thus need not be removed and, as a rule, be destroyed.

If the sliding doors have, at their outer edges facing the end walls of the shower unit, at least one pusher, by means of which all sliding doors can, in their open condition, be shifted to and fro in one go between the two end walls, the maximum access or opening width may quickly be obtained, even if the entire sliding door is three- or multi-winged.

If the heating device may be swiveled away from the adjacent shower unit wall, this shower unit wall is well accessible in the case of need, for instance for cleaning purposes.

Further details, aspects and advantages of the present invention result from the following description of an embodiment by means of the drawing.

Figure 2:
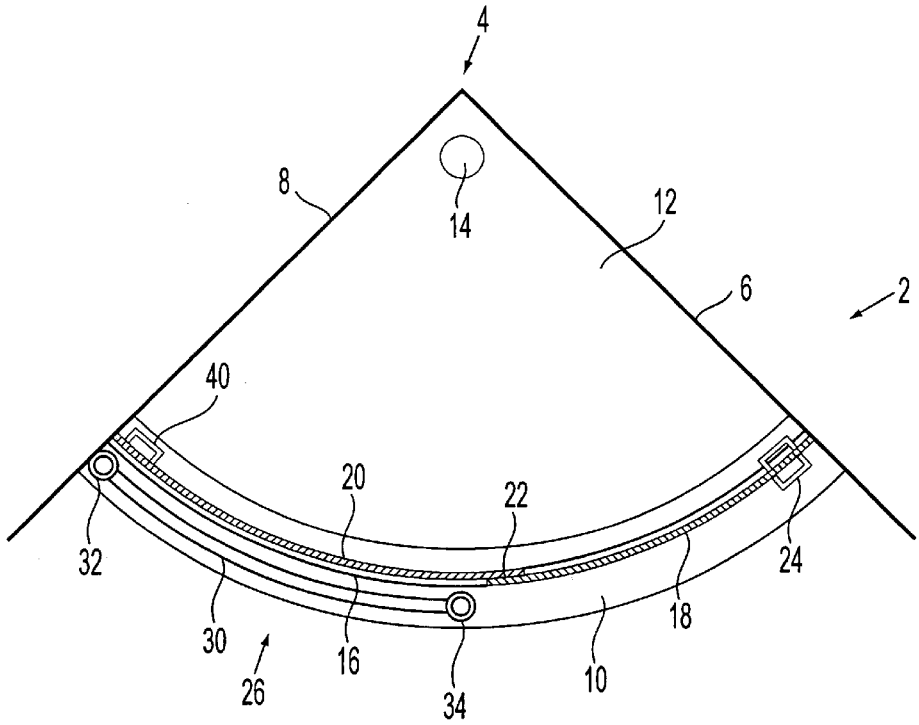
Figure 3A:
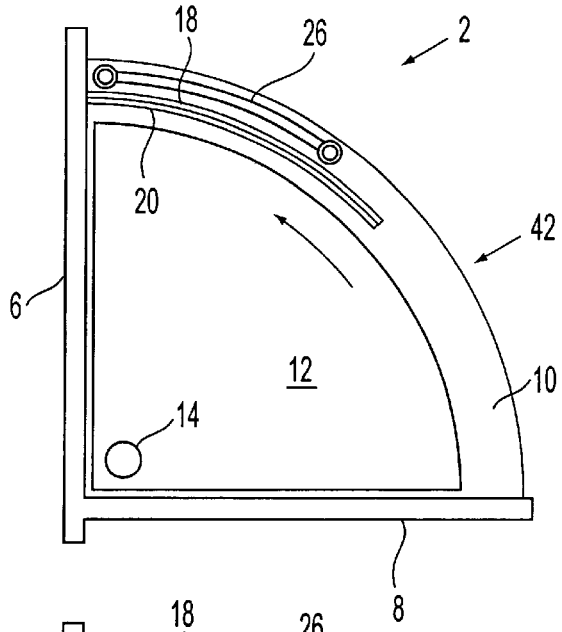
Figure 3B:
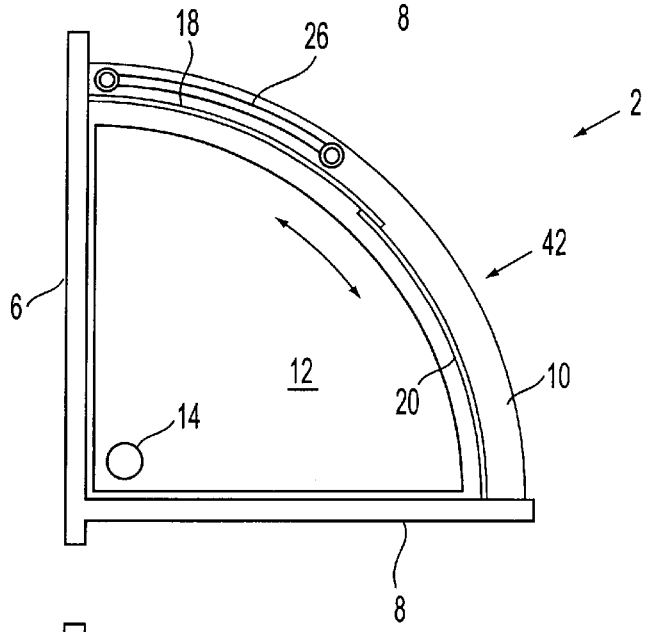
Figure 3C:
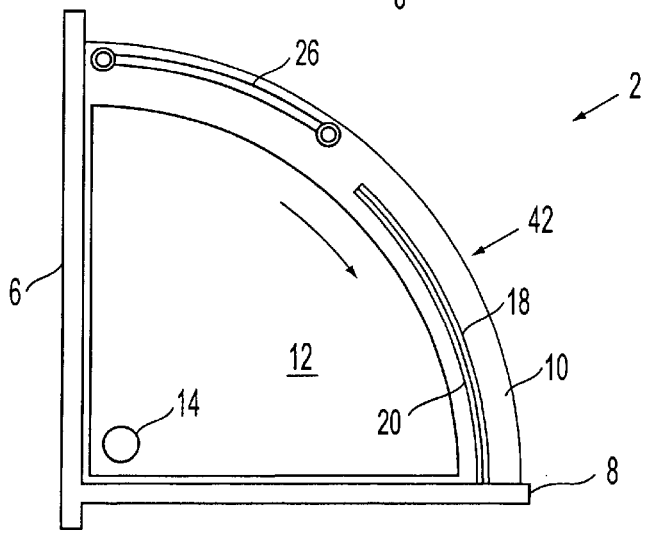
Figure 4A:
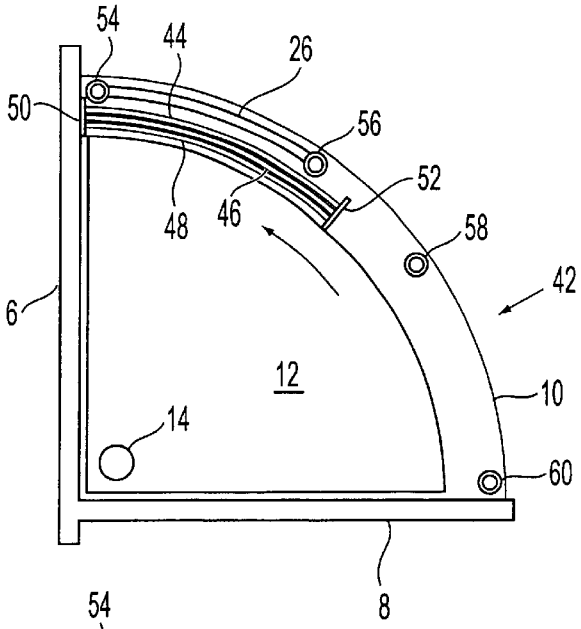
Figure 4B:
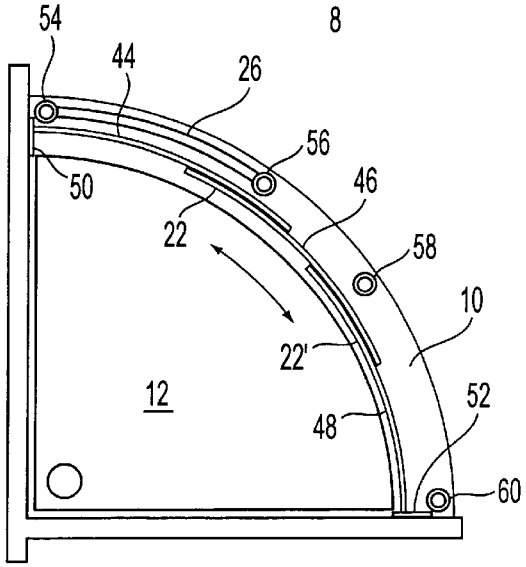
Figure 4C:
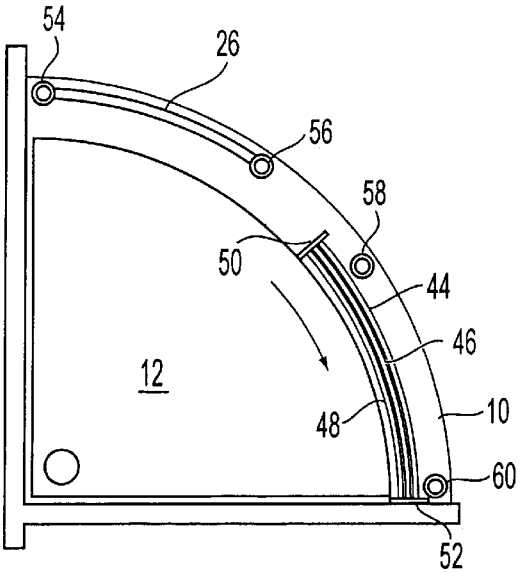

There shows:

FIG. 1 a perspective, simplified illustration of a bathroom unit pursuant to the invention, in the form of a shower unit installed in a corner;

FIG. 2 a likewise simplified top view of the bathroom unit of FIG. 1;

FIGS. 3A to 3C a top view of three different operating conditions or positions of a modification of the bathroom unit pursuant to the invention or of its sliding doors, respectively; and FIGS. 4A to 4C a top view of three different operating conditions or positions of another embodiment of the bathroom unit pursuant to the invention or of its sliding doors, respectively, in the case of a three-winged sliding door.

In the individual Figures of the drawings, identical or corresponding elements have been provided with identical reference numerals.

FIG. 1 shows a perspective view of an embodiment of a bathroom unit pursuant to the invention in the form of a shower unit 2, which, in the embodiment shown, has the shape of a quarter circle and is installed in a corner 4 between two walls 6 and 8. The shower unit 2 comprises in a known manner a base 10 in which a shower tub 12 with an outlet 14 is incorporated. The shower head with the hose, the mixing faucet etc. are not represented in more detail in the drawing to simplify matters.

On the upper horizontal face of the base 10, a guiding member 18 is positioned or formed. The guiding member 16 serves in a known manner to incorporate and slidingly guide a door 18 through which the interior of the shower unit 2 can be entered and which is in the closed condition in contact with the wall 6 via a sealing lip or the like and closes off the interior of the shower unit 2 in a splash-proof manner towards the outside. The door 18 extends in its longitudinal or sliding direction somewhat farther than the half of the quarter circle defined by the shower tub 12 or the base 10, respectively, i.e. over approximately 50° or somewhat more.

The door 18 is, in accordance with an embodiment of the invention, followed by a wall 20 that covers the remaining opening not closed by the door 18. According to FIG. 2, a covering or overlapping area 22 exists between the door 18 and the wall 20 when the door 18 is closed, which ensures that the entire shower unit 2 is sealed off in a splash-proof manner when the door 18 is closed. For opening and closing of the door 18, a handle 24 is provided.

In the region of the wall 20, a heating device 26 is positioned in accordance with the present invention. The heating device 26 may, in accordance with FIGS. 1 and 2, extend substantially over the entire height and the entire width of the wall 20. In the embodiment shown, the heating device 26 is a rung radiator 28 consisting of a plurality of substantially horizontal rungs 30 positioned between two substantially vertical feeders 32 and 34. The heating device 26 may for instance be connected to the cycle of an already existing central heating system; in the embodiment shown in FIG. 1, this connection is performed via two wall-side supply or outlet members 36 and 38, respectively. The supply and outlet members 36 and 38 are guided out of the wall. Likewise, these supply and outlet members might also be guided out of the base 10, with the connection then being performed at the lower ends of the two feeders 32 and 34.

In another embodiment, the heating device 26 may be an electric radiator that generates the necessary heating energy either directly or indirectly via a corresponding heating medium, for instance an oil or the like.

By means of the heating device 26, the interior of the shower unit 2 is heated up through the wall 20, so that the interior of the shower unit 2 is always kept at a comfortable temperature. The heating device, of course, also serves as additional or the only heating device for the room in which the shower unit 2 is accommodated, i.e. for the bathroom, a shower room etc.

According to another embodiment, the wall 20 is not stationary, but is designed in the form of an additional door that is shiftable along the guiding member 16 by means of a handle 40. In the illustration of FIG. 2, the door 18 may thus be moved by means of the handle 24 in clockwise direction along the guiding member 16 so as to obtain access to the interior of the shower unit 2. When the door 18 is shifted counter-clockwise, the shower unit 2 is closed. By means of the handle 40, the door 20 may be opened counter-clockwise in FIG. 2 until it abuts at the wall 8 with its right end in FIG. 2, with the two doors 18 and 20 then overlapping each other. In this position of the door 20, the heating device 26 or the radiator 28 can radiate directly, i.e. without interfering door 20, into the interior of the shower unit 2. When the shower unit is not used, it may thus be heated directly and efficiently. Furthermore, in particular when the heating device 26 is designed in the form of the rung radiator 28, one or several towels may be hung over the individual rungs 30. When the door 20 is closed in accordance with the illustration of FIG. 2, these towels thus are kept in a splash-proof manner and are pre-heated. When the shower process has been finished, the door 18 remains closed and the door 20 is opened at the handle 40 so as to obtain a direct heat radiation into the interior of the shower unit 2, which is felt to be very comfortable when the body is still wet. Furthermore, the towel that has been pre-heated by the heating device 26 may be taken away from the heating device 26, so that drying can be performed with the pre-heated towel within the shower unit 2 still.

FIGS. 3A to 3C show the embodiment just described with two movable sliding doors 18 and 20. It is noted that in FIGS. 3A to 3C (and in FIGS. 4A to 4C which will be described later on) the heating device 26 or the radiator 28, respectively, is positioned in a staggered way relative to the illustration in FIG. 1, i.e. it is adjacent to the wall 6. Furthermore, the guiding member(s) 16 in the base 10 are not illustrated in FIGS. 3A to 4C.

FIG. 3A shows the entrance and exit positions into the shower unit 2 or out of the shower unit 2, respectively. The two sliding doors 18 and 20 are shifted in front of the heating element 18 and open up an entrance 40.

FIG. 3B shows the shower position in which the sliding door 18 remains in its sealing contact with the wall 6 and the sliding door 20 is shifted in the direction of the wall 8 and is in sealing contact with it. The side edges of the doors 18 and 20 opposite to the walls 6 and 8 form the overlapping area 22. In this position of the doors 18 and 20, the shower unit 2 is sealed off in a splash-proof manner towards the outside, and the heating device 26 also is protected from splash water by the sliding door 18.

FIG. 3C shows a position for drying after showering still within the shower unit 2. To this end, the sliding door 18 is shifted in the direction of the wall 8, i.e. both sliding doors 18 and 20 now are in front of the entrance 42, and a pre-heated towel may be taken from the heating device 26 from the interior, with the heating device 26 simultaneously being able to give off heat in an unhindered way into the interior of the shower unit 2.

For releasing the entrance 42, the sliding doors 18 and 20 then are again placed in the position pursuant to FIG. 3A; they are either moved individually (with the position according to FIG. 3B being obtained as intermediate position), or they are moved jointly.

Such joint movement of all sliding doors is of advantage in particular when the shower unit 2 is not, like in the case of FIGS. 1 to 3C, closed off towards the outside by a two-winged door consisting of the two sliding doors 18 and 20, but by a three or multi-winged door, as is illustrated in FIGS. 4A to 4C.

FIGS. 4A to 4C show the structure of a three-winged door consisting of three individual sliding doors 44, 46 and 48. The illustration of FIG. 4A corresponds to the illustration of FIG. 3A, i.e. in FIG. 4A the sliding doors 44, 46 and 48 release the entrance 42. FIG. 4B corresponds to the illustration of FIG. 3B, i.e. FIG. 4B illustrates the showering position in which the sliding doors 44, 46 and 48 close off the entire shower unit 2 in a splash-proof manner towards the outside and overlap each other in two overlapping areas 22 and 22'. FIG. 4C corresponds to the illustration of FIG. 3C, i.e. the position for drying in which the heating device 26 is accessible from the interior of the shower unit 2, so that a towel hung on and pre-heated by the heating device 26 is accessible.

As may best be seen from FIG. 4B, the sliding door 4 comprises a pusher 50 at its edge adjacent to the wall 6, and in analogy does the sliding door 48 comprise another pusher 52 at its edge adjacent to the wall 8. The pushers 50 and 52 may extend in the form of a shoulder over the entire height of the sliding doors 44 and 48, or only over a certain height thereof, for instance 20 cm or more. The width of the pushers 50 and 52 is, in accordance with FIGS. 4A and 4C, chosen such that, in the case of overlapping sliding doors 44, 46 and 48, the end portions of the pushers 50 and 52 rise above the "door package" formed by the sliding doors radially (with respect to the outlet 14) outwardly and inwardly. The pushers 50 and 52 thus serve both as handle elements for seizing and shifting the sliding doors 44 and 48 and as actual pushers, by means of which the "door package" may be placed in one go from the position according to FIG. 4A to the position according to FIG. 4C. If such pushers exist in the embodiment according to FIGS. 3A to 3C, the sliding doors 18 and 20 there may in analogy be placed in one go from the position according to FIG. 3A to the position according to FIG. 3C.

For shifting the sliding doors 44, 46, 48 from the position according to FIG. 4A to the position according to FIG. 4C, it is merely the edge of the pusher 50 projecting into the interior of the shower unit 2 that has to be seized and moved in counter-direction of the arrow in the direction of the wall 8 in FIG. 4A. The sliding doors 46 and 48 are in contact with the pusher 50 and are thus moved together with it and with the sliding door 44 to the position according to FIG. 4C. The same holds true for the movement from the position according to FIG. 4C to the position according to FIG. 4A: the pusher 52 is seized from the interior and moved in counter-direction of the arrow in FIG. 4C in the direction of the wall 6, so that the sliding doors 44 and 46 are placed in the position according to FIG. 4A together with the sliding door 48. This shifting movements may also be performed from outside since the pushers 50 and 52 rise above the door package outwardly, too. For moving the door from the position according to FIG. 4A to the position according to FIG. 4B, the pusher 52 is seized and moved in the direction of the wall 8; between the sliding doors 44, 46 and 48 connecting members are provided in a known manner, which make such movement of the sliding door 48 effect a corresponding entraining movement of the sliding door 46, until the doors 44, 46, 48 have obtained the position illustrated in FIG. 4B with the two overlapping areas 22 and 22'.

FIGS. 4A to 4C furthermore show the possibility of positioning the supplies and outlets for the heating device 26 or the radiator 28 in the base 10. Instead of the feeding of for instance hot water via a flow and return in the wall 8, as illustrated in FIG. 1, the supply of the heating device 26 is performed via two base-side connections 54 and 56. If—as may best be seen from FIG. 4A—two further connections 58 and 60 are provided in the base 10, the shower unit 2 itself as well as with respect to the arrangement of the heating device 26 or of the radiator 28, respectively, may be installed any way. The pair of connections that is not required, i.e. either the pair 58 and 60 in the illustration according to FIGS. 4A to 4C or the connecting pair 54 and 56 if the heating device 26 is connected to the connections 58 and 60, may be closed by suitable cover means, i.e. caps, plugs or the like.

By the arrangement of the heating device 26, quicker drying of the interior of the shower unit 2 is effected, in particular in the position of the sliding doors according to FIGS. 3C and 4C. Another advantage is—as was already mentioned—that one or several towels may be pre-heated by means of the heating device 26, which are then easily accessible from the interior of the shower unit 2 in the position of the sliding doors pursuant to FIGS. 3C and 4C.

It is a matter of fact that the embodiments as described and illustrated in the drawings have to be considered as mere examples. In the scope of the present invention, a plurality of modifications and amendments are conceivable, without deviating from the subject matter of the present invention as it is defined in the following claims and their equivalents.

Thus, for instance, the shape of the base 10 or of the tub 12, respectively, is not restricted to the quarter circular shape illustrated. Square, rectangular, triangular, sector-shaped (e.g. semicircular or quarter circular) or round shapes also are conceivable, with the shapes of the door 18 and of the wall 20 or of the doors 18 and 20, respectively, having to be adapted correspondingly.

Furthermore, the door 20 need not be shiftable in its entirety in analogy to the door 18 along the guiding member 16; it is rather also conceivable that the wall 20 is stationary.

In particular when the connections of the heating device are, for instance in accordance with FIG. 1, formed in the wall, the possibility may be provided that the heating device is designed in a way to be swiveled away from the adjacent wall or sliding door. In the region of the connections 36 and 38, suitable liquid-proof, but swiveling connecting elements then would have to be provided. In particular when the wall 20 is stationary, the outer face of this wall 20 may be reached more easily for cleaning purposes by the possibility of swiveling away the heating device, for instance in the form of the rung radiator 28.

The individual panes of the sliding doors may, of course, be designed at will, i.e. transparent, translucent, completely transparent, mirrored, dyed, structured etc.

Instead of four connections 54, 56, 58 and 60, it may also be sufficient to only provide three such connections, with the connections 54 and 60 being on the 0° position and the 90° position and the third connection being in the middle thereof on a 45° position if the base 10 is for instance designed as a quarter circle. This middle connection then serves either with the connection on the 0° position or the connection on the 90° position as supply or outlet for the heating device or the radiator, in other words, the radiator then extends substantially over a curve length of 45°. Also with this design can the shower unit 2 or the radiator 28, respectively, be installed any way.

If only one sliding door is used in combination with only one stationary wall, this stationary wall then being positioned in front of the radiator, a smaller opening closed by a lid or the like possibly may be formed in this stationary wall, through which access is possible from the interior of the shower unit 2 to a towel hanging on the radiator.

Furthermore, the subject matter of the present invention cannot only be used with firmly installed shower units, but also with so-called shower partitions by means of which a bathtub may be converted to a makeshift shower unit. Instead of a rung radiator, a plate radiator also is conceivable, although a rung radiator should be preferred in practice for optical reasons already.

What is claimed is:

1. A bathroom unit, comprising a shower tub and a shower unit wall substantially defining a showering area and provided with a first door, whereby a heating device extends at least along a partial section of the shower unit wall, characterized in that said shower unit wall comprises a second door in the region of said heating device, said second door opening to allow access to the showering area and to directly expose said heating device to the showering area.

2. The bathroom unit according to claim 1, characterized in that said heating device is positioned outside the shower unit wall.

3. The bathroom unit according to claim 1, characterized in that said shower unit wall and said heating device are curved.

4. The bathroom unit according to claim 1, characterized in that said heating device is a rung radiator.

5. The bathroom unit according to claim 1, characterized in that the first and second doors are sliding doors.

6. The bathroom unit according to claim 5, characterized in that said sliding doors comprise at least one pusher at their outer edges facing end walls of the shower unit, by means of which all sliding doors, in the open condition, can be shifted to and fro in one go between the end walls.

7. The bathroom unit according to claim 1, further comprising a supply member and an outlet member for connecting said heating device to a central heating system.

8. The bathroom unit according to claim 1, characterized in that said heating device is an electric radiator.

9. The bathroom unit according to claim 1, further comprising a base of said shower tub and supply and outlet connections for said heating device, said supply and said outlet connections being incorporated in the base of said shower tub.

10. The bathroom unit according to claim 1, characterized in that said heating device can be swiveled away from the adjacent shower unit wall.

* * * * *